US006053577A

United States Patent [19]

Arko et al.

[11] Patent Number: 6,053,577

[45] Date of Patent: Apr. 25, 2000

[54] CHAIR WITH ADJUSTABLE ARMREST

[75] Inventors: Robert P. Arko, Palo Alto, Calif.; Eric T. McClure, Grand Rapids, Mich.; Kenneth J. Penning, Grand Rapids, Mich.; Mark S. Drelles, Grand Rapids, Mich.

[73] Assignee: Steelcase Development Inc., Grand Rapids, Mich.

[21] Appl. No.: 09/026,493

[22] Filed: Feb. 20, 1998

[51] Int. Cl.[7] ..... A47C 7/54

[52] U.S. Cl. ..... 297/411.35; 297/240; 297/411.31

[58] Field of Search ..... 297/240, 241, 297/242, 411.31, 411.35, 411.2, 411.3

[56] References Cited

U.S. PATENT DOCUMENTS

| | | | |
|---|---|---|---|
| D. 393,968 | 5/1998 | Penning et al. . | |
| 533,619 | 2/1895 | Stuebing . | |
| 1,706,634 | 3/1929 | Seils . | |
| 1,721,221 | 7/1929 | Jauregui | 297/411.35 X |
| 2,440,644 | 4/1948 | Powell | 297/240 X |
| 2,694,439 | 11/1954 | Murray | 297/240 |
| 3,124,328 | 3/1964 | Kortsch . | |
| 3,568,972 | 3/1971 | Sherman | 248/429 |
| 4,085,967 | 4/1978 | Spencer . | |
| 4,163,536 | 8/1979 | Heller et al. . | |
| 4,277,102 | 7/1981 | Aaras et al. . | |
| 4,645,167 | 2/1987 | Hardwick | 297/188.21 X |
| 4,951,995 | 8/1990 | Teppo et al. . | |
| 5,104,073 | 4/1992 | VanBeek et al. . | |
| 5,116,098 | 5/1992 | Wooten | 297/240 X |
| 5,135,190 | 8/1992 | Wilson . | |
| 5,143,422 | 9/1992 | Althofer et al. . | |
| 5,215,282 | 6/1993 | Bonutti . | |
| 5,281,001 | 1/1994 | Bergsten et al. . | |
| 5,369,805 | 12/1994 | Bergsten et al. . | |
| 5,380,065 | 1/1995 | Rohrer . | |
| 5,407,249 | 4/1995 | Bonutti . | |
| 5,529,374 | 6/1996 | Wimberly, Jr. | 297/240 |
| 5,597,208 | 1/1997 | Bonutti . | |
| 5,704,729 | 1/1998 | Carnahan et al. | 297/344.24 X |

FOREIGN PATENT DOCUMENTS

| | | |
|---|---|---|
| 948391 | 12/1995 | Japan . |
| 951938 | 2/1996 | Japan . |
| 952268 | 2/1996 | Japan . |

OTHER PUBLICATIONS

Exhibit A: "VR Chair Hypen, " Manufactured by Daikoku–Denki, published 1996.

*Primary Examiner*—Peter R. Brown

*Attorney, Agent, or Firm*—Price Heneveld Cooper DeWitt & Litton

[57] ABSTRACT

A chair includes a base, a seat supported on the base and defining right and left sides, and an armrest. The armrest includes an armrest support rotatably supported under the seat on a bearing mechanism on the base for 360° of movement around the seat, including movement to positions adjacent the right and left sides of the seat. The seat is slidably supported on the base for movement between a forward use position and a rearward position, the rearward position permitting increased clearance in front of the seat for adjustment of the armrest, but the seat being normally biased toward the forward position by a spring device. The base includes a control for supporting a reclineable back.

16 Claims, 5 Drawing Sheets

CHAIR WITH ADJUSTABLE ARMREST

BACKGROUND OF THE INVENTION

The present invention relates to chairs having armrests, and more particularly relates to a chair having an adjustable armrest that is adjustable between right and left side positions and that has a seat accommodating such movement.

It is often desirable to use chairs that take up a minimum of space in areas where space is particularly valuable or limited. For example, gaming businesses in Japan called "pachinko" parlors often use chairs that take up a minimum of space, so that patrons are comfortably but closely positioned in front of gaming devices. This permits a maximum number of patrons to be accommodated at one time. At the same time, it is desirable to support the seated user's arm(s) while playing a particular game, yet the armrest must be able to allow the patron to enter and exit the chair with ease when beginning or finishing a game. This problem is compounded by chair armrests that interfere with entering and exiting a chair from a rear angle to the chair, and further is compounded by armrests that do not adequately adjustably support a person's arm during use. At the same time, the cost and complexity of chairs and armrests must be minimized to remain marketable in the competitive chair industry.

Chairs that maximize space utilization and/or that have adjustable armrests are also desired in office areas where significant amount of tasks are performed while seated in the chairs. Further, chairs having a distinctive appearance are always in demand.

Accordingly, a chair having an adjustable armrest is desired that satisfies the aforementioned needs.

SUMMARY OF THE INVENTION

In one aspect of the present invention, a chair includes a base, a seat supported on the base and defining right and left sides, and an armrest. The armrest includes an armrest support rotatably supported under the seat on one of the base and the seat for movement between a first position adjacent the right side and a second position adjacent the left side.

In another aspect, a chair includes a base including a bearing, a seat slidably supported on the base for movement between forward and rearward positions, the seat defining right and left sides, and an armrest with an arm support operably attached to the bearing for rotational movement around the seat between the right and left sides.

In still another aspect, a chair includes a base having a bottom configured to stably engage a floor surface, a control constructed to operably support a reclineable back, and a bearing mechanism located between the bottom and the control. An armrest is rotatably supported on the base by the bearing mechanism for movement between right and left sides of the base. A seat is slidably supported on the control for movement between a forward position for supporting a seated user and a rearward position permitting adjustment of the armrest around a front of the seat between the right and left sides.

In yet another aspect, a method includes steps of providing a chair including a seat and an armrest rotatably mounted to the chair under the seat for movement around the chair between right and left sides of the chair, and rotating the armrest around the seat between the right side and the left side.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
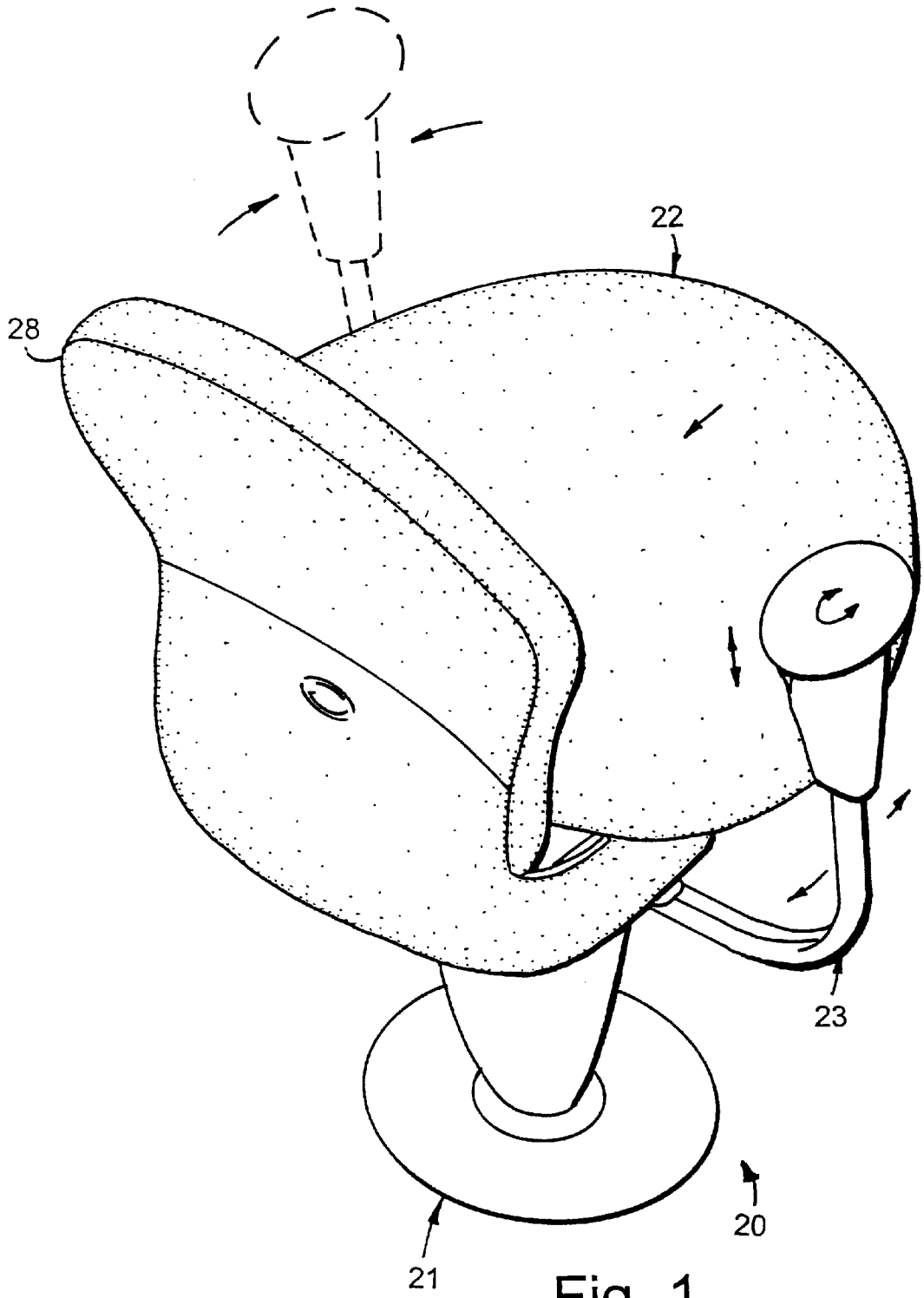
FIG. 1 is a rear perspective view of a chair having an adjustable armrest embodying the present invention.

A chair 20 (FIGS. 1 and 2) embodying the present invention includes a base 21, a seat 22 with seat stiffener 22' operably supported on the base 21, and an armrest 23. The armrest 23 includes an L-shaped armrest support 24 rotatably supported under the seat 22 by a bearing mechanism or mount 25 on the base 21. The bearing mechanism 25 rotatably supports the armrest 23 for 360° of movement around a perimeter of the seat 22, including movement to right or left sides of the seat 22. The seat 22 is slidably supported on the base 21 by a seat slide mechanism 27 (FIG. 3) for movement between a forward use position and a rearward position, the rearward position permitting increased clearance in front of the seat 22 for adjustment of the armrest 23, but the seat slide mechanism 27 normally biasing the seat 22 toward the forward position by gravity or via a spring to automatically position the seated user close to the particular gaming device being used or close to the particular work being done. A control 26 under the seat 22 operably supports a reclineable back 28 on the chair 20 to provide still greater user comfort.

The base 21 (FIG. 3) includes a floor-engaging bottom 30 that stably supports the chair 20 on a floor surface 31, and an upwardly extending internal frame 33. The illustrated bottom 30 is secured to the floor surface, but it is contemplated that other bases (wheeled and wheel-less) could also be used. An inner sleeve 32 is attached to the bottom 30 and covers a lower part of the internal frame 33. The bearing mechanism 25 is secured to a top end of the internal frame 33, and the seat slide mechanism 27 is secured to a top of the bearing mechanism 25, as described below. The control 26 is secured to a top of the slide mechanism 27, which control 26 both supports the seat 22 on the seat slide mechanism 27 and operably supports the back 28 for recline. An outer sleeve 34 extends from the control 26 downwardly telescopingly around the inner sleeve 32 for covering an upper portion of the internal frame 33 and related areas of the base 21. An under-seat cover 35 covers the area under the seat 22, including the control 26, the seat slide mechanism 27, and an upper portion of the internal frame 33.

Figure 8:
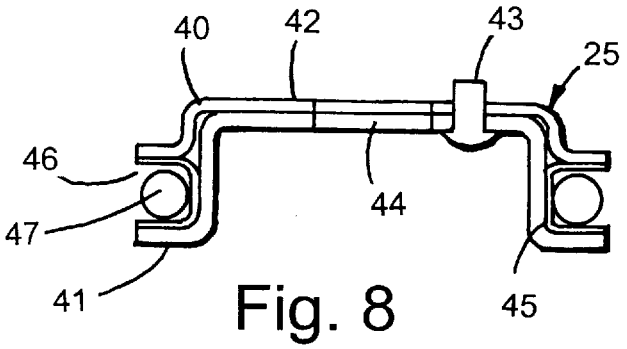
FIG. 8 is an enlarged cross-sectional view of the bearing mechanism shown in FIG. 7.
Figure 7:
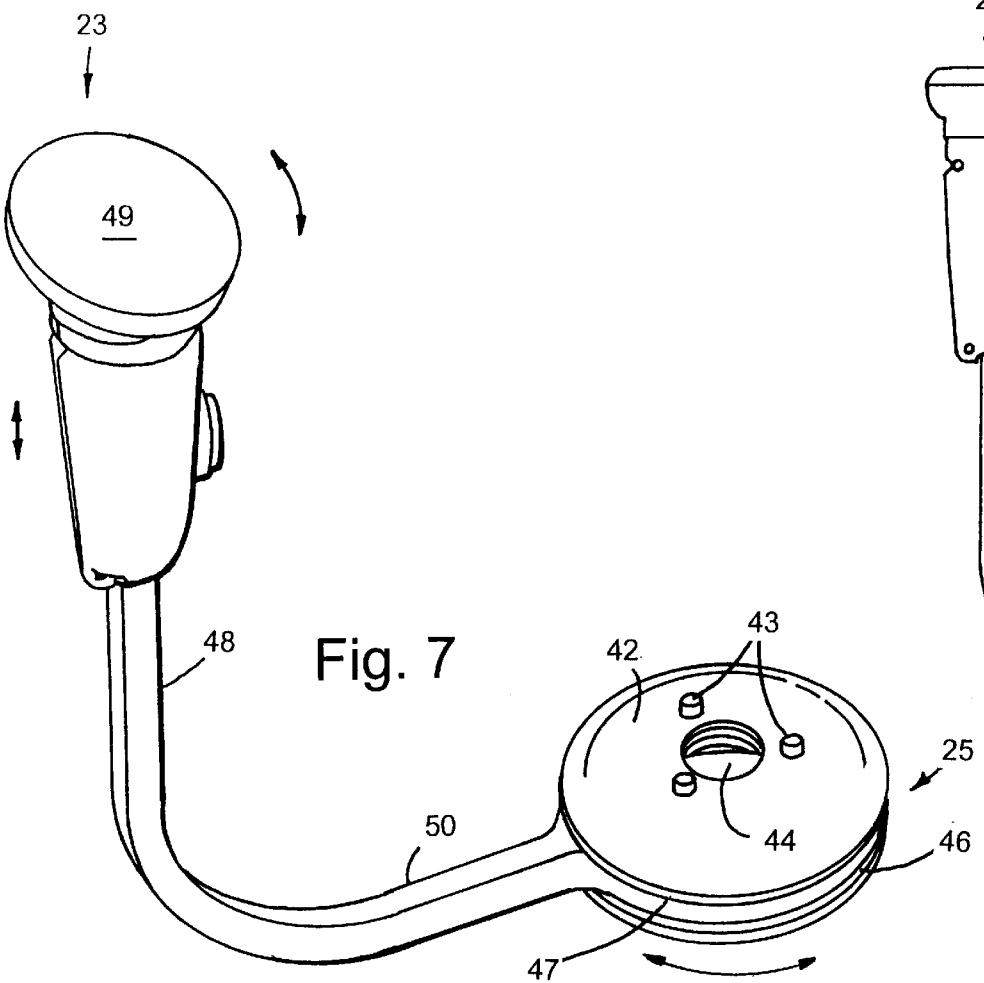
FIG. 7 is a perspective view of the armrest and armrest support shown in FIG. 5.

The bearing mechanism or mount 25 (FIGS. 7 and 8) includes upper and lower dish-shaped plates 40 and 41. The upper and lower dished plates 40 and 41 are both inverted to face downwardly, with the lower dished plate 41 having a deeper concavity so that they form a U-shaped circumferential channel 46 around their perimeter. The lower dished plate 40 is attached to a top of the internal frame 33. The upper dished plate 40 is attached on top of lower plate 41 with their center areas 42 abutting. The plates 40 and 41 are interconnected by fasteners 43 spaced around a center hole 44. A lubricous bearing, such as plastic bearing 45, is positioned in the U-shaped circumferential channel 46 defined by the outer flanges of the dished plates 40 and 41. The arm support 24 includes a ring-shaped end 47 configured to fit mateably into the channel 46. The dished plates 40 and 41 are fastened together with fasteners 43 with the ring-shaped end 47 captured therebetween, so that the ring-shaped end 47 is slidably and rotatably supported by the bearing 45. It is contemplated that a variety of different arm supports can be constructed that are within the scope of the present invention. The illustrated arm support 24 is L-shaped, and is formed from a continuous rod having an intermediate section bent into the ring-shaped end 47, and opposing ends that are bent into the parallel L-shaped configurations shown in FIG. 2. Specifically, the L-shaped portion of the arm support 24 includes a vertical section 48 that supports the armrest pad 49 of armrest 23, and further includes a horizontal section 50 that positions the vertical section 48 outward of the perimeter of the seat 22 so that the armrest 23 can be rotated 360° around the seat 22. Depending on the shape of the seat 22 and the length of horizontal section 50, the seat 22 may need to be slid rearwardly in order for the armrest 23 to be rotated around a front of the seat 22. It is contemplated that the armrest pad 49 can be adjustably supported on the vertical section 48 by several different structures and mechanisms, and it is not believed to be necessary to describe all such structures and mechanisms in order to understand the present invention. Nonetheless, it is noted that the illustrated armrest pad 49 is operably supported on an axle that extends into the vertical section 48 for rotational movement, and is further telescopingly/slidably supported on the vertical section 48 for vertical adjustment.

Figure 4:
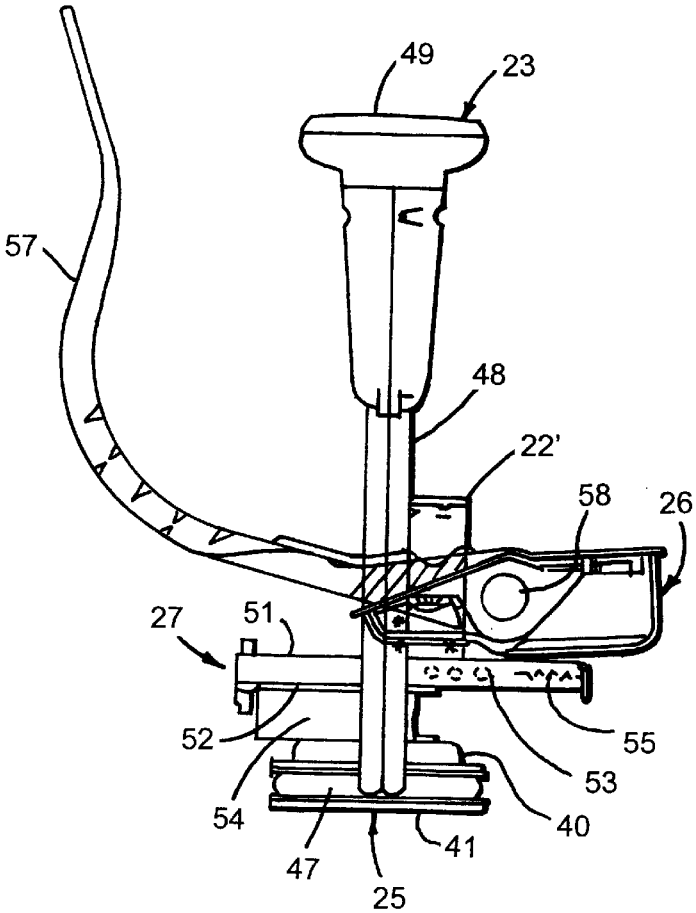
FIG. 4 is a side cross-sectional view like FIG. 3, but showing only the armrest, the bearing mechanism for supporting the armrest, the control, the seat slide mechanism, and the back upright.
Figure 5:
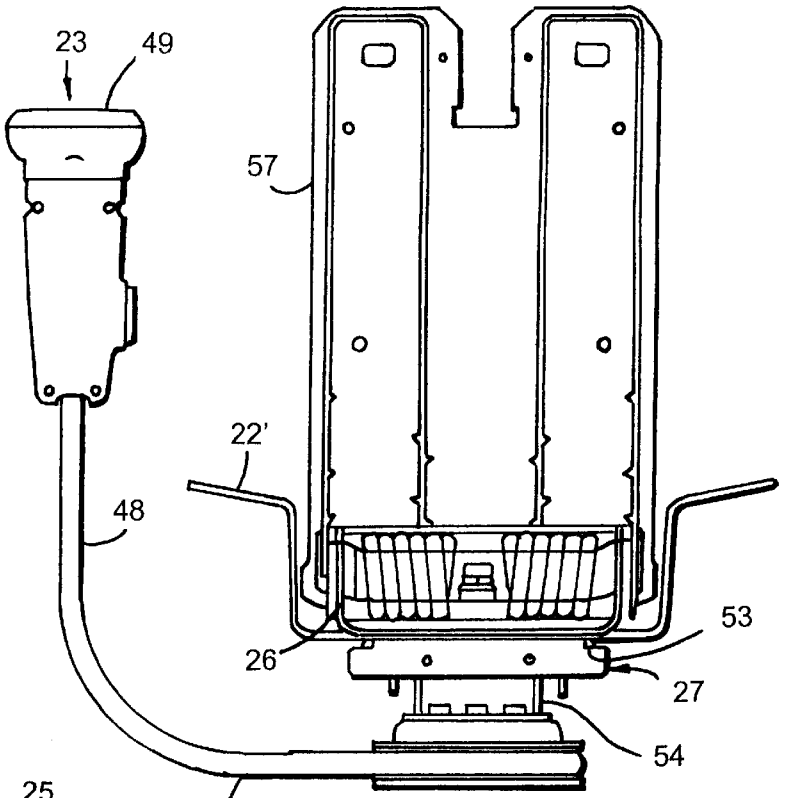
FIG. 5 is a rear view of FIG. 4.

The seat slide mechanism 27 (FIGS. 4 and 5) includes upper and lower slide brackets 51 and 52 slidably interconnected by roller bearings 53 or a suitable equivalent. The lower bracket 52 is attached to the upper dished plate 40 by a U-shaped stanchion 54 that spaces the lower bracket 52 above the upper dished plate 40. The control 26 is attached to the upper slide bracket 51, and the lower bracket 52 operably supports the upper bracket 53 and the control 26 (and the seat 22) thereon for sliding movement. The seat slide mechanism 27 includes an internally located biasing device 55 operably connected between the slide brackets 51 and 52, such as a coil spring, for biasing the seat 22 toward the forward position, thus maximizing the area behind the seat 22. Alternatively, the upper and lower brackets 51 and 52 can include forwardly angled flanges so that the seat 22 naturally slides toward a forward position by gravity.

The control 26 (FIG. 3) includes a housing 56 attached to the upper slide bracket 51, a back upright 57 pivoted to the housing 56 for movement between upright and reclined positions, and a spring mechanism 58 located at the pivotal connection of the back upright 57 to the housing 56 for biasing the upright 57 toward the upright position. A back cover 59 covers a rear surface of the back 28, and a rear end of the under-seat cover 35 is configured to receive the back 28 and a lower portion of the back cover 38 during recline.

Figure 2:
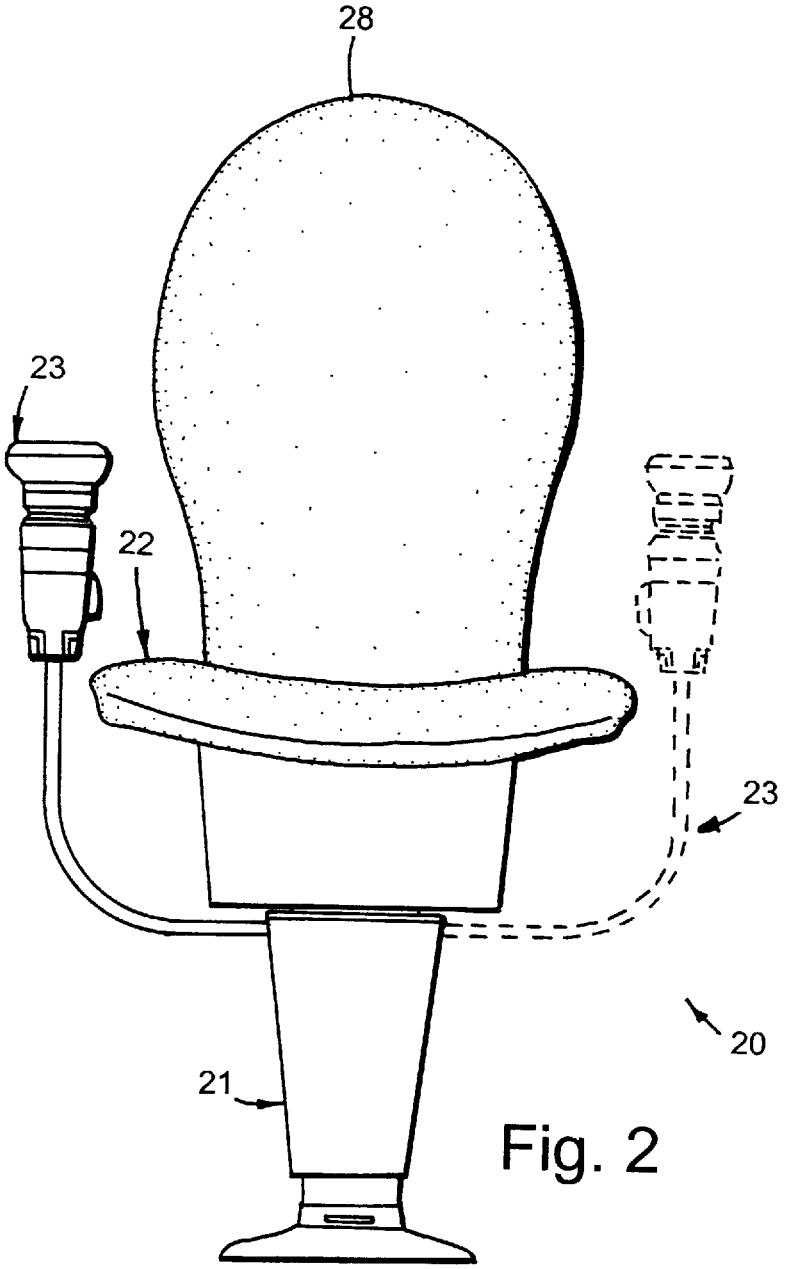
FIG. 2 is a front view of the chair shown in FIG. 1, including the armrest positioned on the right side of the chair in solid lines and on the left side of the chair in dashed lines.
Figure 3:
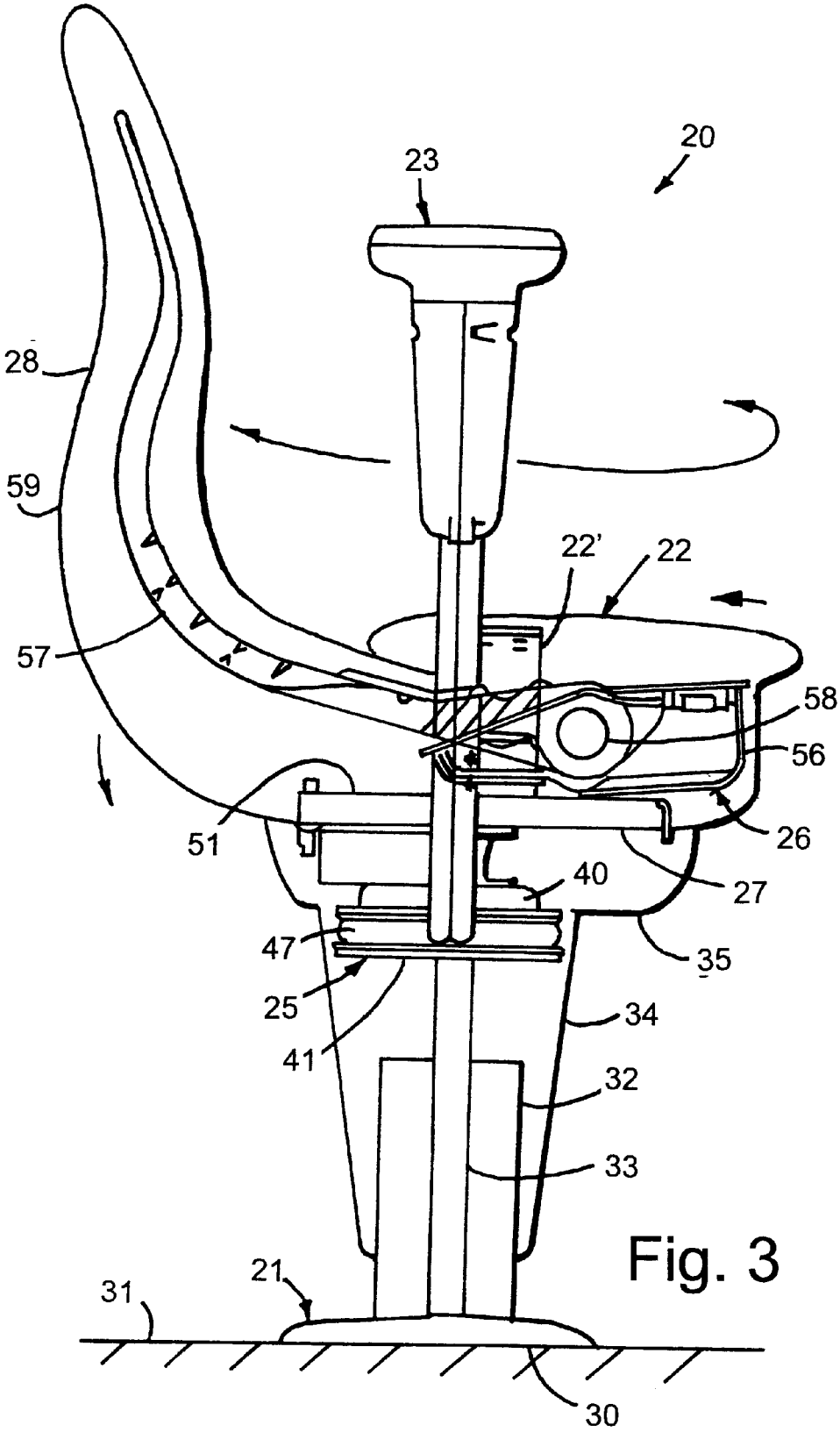
FIG. 3 is a side cross-sectional view of the chair shown in FIG. 1.
Figure 6:
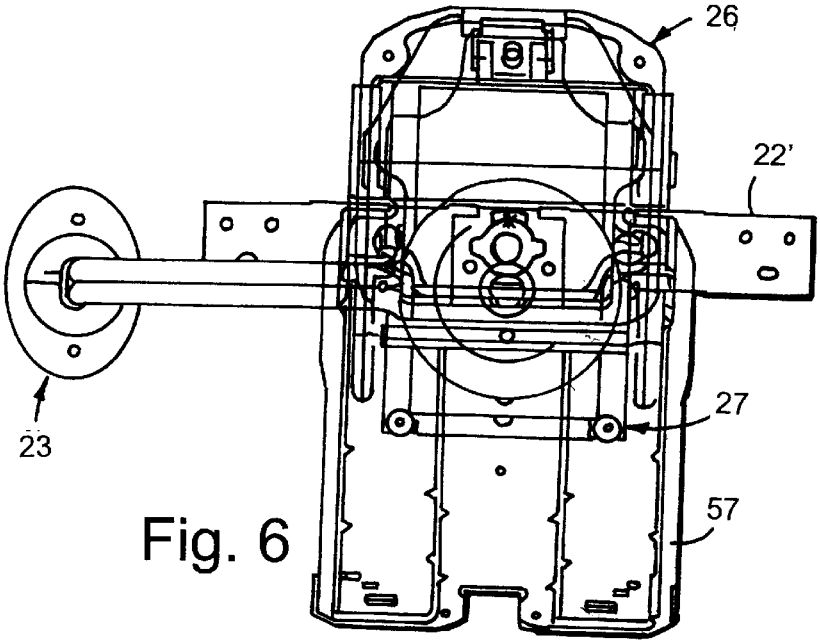
FIG. 6 is a bottom view of FIG. 4.

Chair 20 (FIG. 2) illustrates the right and left side positions of the armrest 23 on the chair 20, one side position being for supporting a right arm of a seated user, and the other side position being for supporting a left arm of a seated user. FIG. 2 also illustrates that a pair of armrests 23 can be supported on the bearing mechanism 25, such as by welding a second L-shaped armrest support 24 onto the ring-shaped end 47.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A chair comprising:

a base including a slide mechanism;

a seat slidably supported on the base by the seat slide mechanism and defining a right sides and a left side;

a bearing mechanism supported by at least one of the base and the seat; and an armrest including an armrest support rotatably supported under the seat by the bearing mechanism for movement between a first use position adjacent the right side and a second use position adjacent the left side; and wherein the seat slide mechanism is configured to move the seat between a rearward position providing increased clearance at a front of the seat so that the armrest can be moved around the front of the seat between the first and second positions, and a "normal use" forward position where the front of the seat interferes with moving the armrest around the front of the seat.

2. The chair defined in claim 1 wherein the armrest is rotatably supported by the bearing mechanism on the base.

3. The chair defined in claim 2 wherein the armrest is rotatably supported by the bearing mechanism on the seat.

4. The chair defined in claim 2 wherein the bearing mechanism includes a pair of opposing plates that are attached together to form a circumferential bearing surface.

5. The chair defined in claim 4 wherein the armrest is configured to rotate around a front of the seat when moving between the first and second positions.

6. The chair defined in claim 5 wherein the armrest is operably supported for rotation along at least 180° of movement around the seat.

7. The chair defined in claim 1 wherein the armrest is operably supported by the bearing mechanism for rotation of at least 180° around the seat.

8. The chair defined in claim 7 wherein the armrest is operably supported by the bearing mechanism for rotation of 360° around the seat.

9. The chair defined in claim 1 including a control having a housing attached to the base, and a reclineable back pivotably supported by the housing for movement between an upright position and a reclined position.

10. The chair defined in claim 9 wherein the armrest support is rotatably supported on the base under the control at a location separate from the control.

11. The chair defined in claim 1 wherein the armrest support is a single piece, is L-shaped, and has a vertical section extending above the seat, and a horizontal section spacing the vertical section horizontally outwardly from the base a radial distance at least equal to a forward edge and corner of the seat.

12. The chair defined in claim 1 wherein the armrest support has a ring-shaped end, and wherein the ring-shaped end rotatably engages the bearing mechanism.

13. The chair defined in claim 1 wherein the armrest comprises the only armrest on the chair.

14. The chair defined in claim 1 wherein the base includes a floor-engaging bottom, an internal frame extending from the floor-engaging bottom, and a bearing mechanism; wherein the armrest includes a configured end for rotatably engaging the bearing mechanism, and wherein the seat includes a slide mechanism attached atop the bearing mechanism.

15. A chair comprising:

a base including an upwardly extending lower cover and a downwardly extending upper cover, the upper and lower covers telescopingly engaging each other;

a seat supported on the base and defining a right side and a left side;

a bearing mechanism supported by at least one of the base and the seat;

an armrest including an armrest support having a ring-shaped end that rotatably engages and is supported under the seat by the bearing mechanism for movement between a first position adjacent the right side and a second position adjacent the left side; and wherein the upper cover is configured to rotate with the armrest and the lower cover is configured to remain stationary with the base.

16. A method comprising steps of:

providing a chair including a seat and an armrest rotatably mounted to the chair under the seat for movement around the chair between a right side of the chair and a left side of the chair;

sliding the seat to a rearward position;

rotating the armrest around the seat between the right side and the left side; and sliding the seat to a forward position after the step of rotating the armrest.

* * * * *